US008597090B2

(12) United States Patent
Byrne

(10) Patent No.: US 8,597,090 B2
(45) Date of Patent: Dec. 3, 2013

(54) COIN COUNTER AND DISTRIBUTOR

(76) Inventor: Norman R. Byrne, Ada, MI (US)

( * ) Notice: Subject to any disclaimer, the term of this patent is extended or adjusted under 35 U.S.C. 154(b) by 381 days.

(21) Appl. No.: 12/693,318

(22) Filed: Jan. 25, 2010

(65) Prior Publication Data

US 2010/0190427 A1 Jul. 29, 2010

Related U.S. Application Data

(60) Provisional application No. 61/146,836, filed on Jan. 23, 2009.

(51) Int. Cl.
*G07D 9/00* (2006.01)

(52) U.S. Cl.
USPC ..... 453/58; 453/60; 453/61; 453/62

(58) Field of Classification Search
USPC ..... 453/58–63; 206/0.8, 0.81; 446/8–13; 221/296, 297; 141/331–334; 232/64–66
See application file for complete search history.

(56) References Cited

U.S. PATENT DOCUMENTS

| | | | | | |
|---|---|---|---|---|---|
| 2,796,068 | A | * | 6/1957 | Healy | 248/206.5 |
| 3,877,473 | A | * | 4/1975 | Williams | 221/297 |
| 3,999,563 | A | * | 12/1976 | Frias, Jr. | 453/60 |
| 4,244,157 | A | * | 1/1981 | Vondra et al. | 53/254 |
| 4,913,201 | A | * | 4/1990 | Lucero et al. | 141/334 |
| 5,067,530 | A | * | 11/1991 | Short, III | 141/98 |
| 5,441,448 | A | * | 8/1995 | Yang | 453/60 |
| 6,499,277 | B1 | | 12/2002 | Warner | |
| 6,510,973 | B1 | | 1/2003 | Ichioka | |
| 6,793,571 | B2 | | 9/2004 | Chung | |

* cited by examiner

*Primary Examiner* — Jeffrey Shapiro
(74) *Attorney, Agent, or Firm* — Varnum, Riddering, Schmidt & Howlett LLP

(57) ABSTRACT

A coin apparatus (100) includes a central housing (102) with a coin holding interior (104). An upper funnel/distributor section (114) facilitates removal of excess coins when said interior is being filled with a predetermined number of coins. The coin apparatus (100) also includes coinage selectors (121), each having an allocation slot (122). Extending inwardly towards the center of the allocation slot (122) is a resilient arm (124) having a button (126) at the end thereof. Each button (126) has an inner edge (127) which is capable of securely abutting edges (128) of one or more of the coins (126) when forces are exerted by the user.

8 Claims, 3 Drawing Sheets

COIN COUNTER AND DISTRIBUTOR

CROSS-REFERENCE TO RELATED APPLICATIONS

This application is based on and claims priority of U.S. Provisional Patent Application Ser. No. 61/146,836 filed Jan. 23, 2009.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to coinage storage apparatus and, more particularly, to apparatus for stacking and distributing predetermined number of coins.

2. Background Art

Various types of devices have been developed for sorting, stacking and storing various denominations of coins. The storage of these coins is typically provided for purposes of filling standard coin wrappers. The standard coin wrappers are typically in the form of tubular paper coin wrappers designed to hold a specific number of coins of a single denomination. In addition to the foregoing, it would also be advantageous if a coin storage device could be used not only for providing a count of a predetermined number of coins to be used for filling a standard coin wrapper, but also could be used for purposes of potentially distributing a predetermined portion of the number of coins which may make up a "filled" coin wrapper.

Among the known devices associated with coin counting and storage is a device disclosed in Yang, U.S. Pat. No. 5,441,448 issued Aug. 15, 1995. Yang discloses a device which is directed to the counting, storage and stacking of coins for filling standard coin wrappers. The device includes a series of coin tubes which are clustered in a parallel relationship. Each coin tube consists of a hollow cylindrical tube for receiving and holding coins of a given denomination within a stack. Each tube has a bottom support surface and an open top surface.

Further, each tube also includes a transverse slot which is perpendicular to the longitudinal axis of the coin tube. The transverse slot has a transverse bottom edge positioned so that a stack of coins between the bottom support surface of the tube and the transverse bottom edge of the transverse slot fills a standard coin wrapper for that particular denomination of coin. The transverse slot is dimensioned so as to allow extra coins stacked above the transverse bottom edge to slide out of the tube through the transverse slot. A series of coin "keeper clips" is insertable within the transverse slots to prevent coins from sliding out of the transverse slots. A series of funnels is also provided, with one funnel being associated with the open top of each coin tube.

In general, Yang discloses a singular device which allows for sorting and storage of coins of differing denominations. Further, the Yang device allows for sliding coins off of a flat surface into an appropriate receptacle within the device.

Ichioka, U.S. Pat. No. 6,510,973 issued Jan. 28, 2003 is specifically directed to a coin case for an automobile. The coin case includes a casing which can be attached to a vehicle. The casing is formed with a series of independent and cylindrical chambers which are sortingly loaded with a series of coins of different denominations. A coin tray is provided which is connected to a side end portion of the casing. The coin tray includes a bottom wall which has a curved surface, which curves in a direction toward the series of independent cylindrical chambers from a place which is relatively spaced apart from the coin case. Caps and coil-type springs are inserted into the respective cylindrical chambers from lower opening ends of the chambers. The device also includes a series of stopping lips formed on the upper surface of the upper wall above the upper opening end portions of the chambers. Each stopping lip stops and refrains the coins from coming out of the respective cylindrical chambers. The caps are sandwiched between the stopping lips and the springs, with the springs urging and pushing the caps upwardly. The stopping lips prevent the caps from being ejected from the upper opening ends of the chambers.

Chung, U.S. Pat. No. 6,793,571 issued Sep. 21, 2004 describes a size-changeable coin bank for counting coins. The bank includes a main body having a cylinder with a coin slot and a funnel with a coin slot. The funnel is screw-jointed to the cylinder, and a counting cylinder is inserted into the funnel and moved up and down. The counting cylinder includes an open bottom, a scale marked on the outer surface, and a metal lid attached to the top surface. Coins are inserted into the counting cylinder through the metal lid, and an ornament attached to the metal lid is screw-jointed to the counting cylinder. The size of the coin bank is changeable by moving the counting cylinder up and down. The main body and/or the counting cylinders are polygonal. The cylinder, funnel and counting cylinders are made of a transparent material and advertisement paper or film can be inserted into the inner or attached to the outer of the cylinder, or attached to the funnel and the counting cylinders. The coin bank can also include a sensor or an IC chip for making a sound and for providing lighting.

Blake et al, U.S. Pat. No. 7,018,286 issued Mar. 28, 2006 describes a coin stacking device which is used to refill a coin cassette of a coin dispenser. The stacking device includes a cylindrical structure having an inner diameter which is approximately the same as the diameter of the coins. The cylindrical structure includes one open end and one closed end. The coins enter the open end and form a coin stack within the cylindrical structure. To refill a coin cassette, the open end of the filled coin stacking device is aligned with a coin receptacle in the coin cassette that is in need of coins. The coin stack can then be transferred from the coin stacking device to the coin receptacle of the cassette. The coin stacking device can be filled by an automated coin processing machine, such as a coin sorting machine or a coin counting machine.

Warner, et al, U.S. Pat. No. 6,499,277 issued Dec. 31, 2002 discloses a mechanical coin wrapper for wrapping coins. The coin wrapper includes a coin input region for receiving the coins, a coin queuing mechanism for receiving the coins from the coin input region and moving the coins away from the coin input region. The coin stacking region receives the coins from the coin queuing mechanism and stacks the coins on at least one stacking element so as to create a coin stack. A coin wrapping region receives a coin stack on the stacking element from the coin stacking region. The wrapping region includes a plurality of rollers for rotating the coin stack and a paper feed mechanism for introducing the paper to be wrapped around the coin stack.

SUMMARY OF THE INVENTION

In accordance with the invention, a coin counter/distribution apparatus is provided for counting, storing and distributing a series of coins. The apparatus includes a central housing with an outer exterior and a coin holding interior. The interior is sized so as to hold a predetermined number of coins of a selected coinage. Upper means are connected to the central housing for providing for an excess of the coins to drop away from the coin apparatus in response to a user manually applying tipping forces to the apparatus.

The upper means includes an upper funnel/distributor section connected to an upper portion of the central housing. The section includes an opening in its center, corresponding substantially in diameter to the diameter of the coin holding interior. A funnel section is provided in the form of a part of an inverse frustrum-shaped conical configuration. The funnel section includes a section having an upper surface which is inclined or slanted downwardly and inwardly toward an upper portion of the coin holding interior. In addition to the funnel section, the funnel/distributor section includes a trough. The trough is connected to or integral with a funnel section and includes an upper surface having a relatively horizontally disposed surface.

A height of the central housing is configured so that when the coin holding interior holds an appropriate number of coins, an upper one of the coins will be substantially flush with the open central portion of the upper funnel/distributor section. Excess ones of coins beyond a number of coins for which the coin apparatus is to hold, will extend above the open central portion of the funnel/distributor section. If the user slightly tips the apparatus in a predetermined direction substantially corresponding to the position of the trough, the excess coins will slide out of the funnel/distributor section onto an upper surface of the trough.

In accordance with another aspect of the invention, the coin holding interior is hollowed and formed within the central housing, with the central housing having a housing exterior. Distributing means are provided for distributing a predetermined number of the coins stored within this central housing, in response to manually exerted forces applied toward the housing exterior. The apparatus also includes means for indicating to the user the portion of the total number of coins being held by the coin apparatus, which is represented by the predetermined number of the coins. The portion of the stored coins is indicated to the user as a fraction of the total number of coins held by the coin apparatus.

The distributing means for providing for the user to distribute a predetermined number of the coins includes means for providing the user with a capability of selecting the predetermined number of coins from a plurality of available portions selectable by the user. This occurs by the user applying forces towards the housing exterior at different locations on the exterior.

The coin apparatus includes a series of indicator apertures extending through the housing exterior and having a vertically disposed configuration on the exterior. This provides for a visual means for a user to determine a number of stored ones of the coins, when the coin holding interior is only partially full. The diameter of each of these indicator apertures exceeds the thickness of any one of the stored coins.

The means for distributing a predetermined number of coins from the coin apparatus includes a series of coinage selectors for providing means for the user to manually select a predetermined number of coins to be distributed through use of the apparatus. The coin selectors are positioned in a configuration where one coin selector is above or below other ones of the coin selectors. In one embodiment, the position of the coin selectors can be staggered around the housing exterior.

Each of the coin selectors includes an allocation slot extending through the housing exterior. A resilient arm is extendable at least partially inwardly toward the coin holding interior. Each of the coin selectors further includes a button connected to or integral with a corresponding one of the resilient arms, positioned at an end of the corresponding one of the resilient arms and including an inner edge. The resiliency of each arm and corresponding button is sufficient so that if a user exerts manually directed forces against one of the buttons in a direction toward the housing exterior, the button will sufficiently operate so that the inner edge will securely abut one or more edges of one or more of the coins within the exterior.

The coin apparatus can also include visual indicia incorporated within an outer surface of the housing exterior, so as to indicate to the user that if a particular one of the resilient arms and a corresponding button associated with a particular one of the allocation slots was to be depressed, a particular portion of the total coinage stored within the central housing will be above an uppermost coin which would be abutted by the inner edge. In this regard, if the user wished to distribute a certain portion of the coinage, the user could depress one of the buttons and invert an entirety of the coin apparatus, with an appropriate portion of the total amount of a full set of the coins, through gravity, falling through the central housing and outwardly from the coin apparatus.

BRIEF DESCRIPTION OF THE DRAWINGS

The invention will now be described with respect to the drawings, in which.

DETAILED DESCRIPTION OF THE INVENTION

Figure 1:
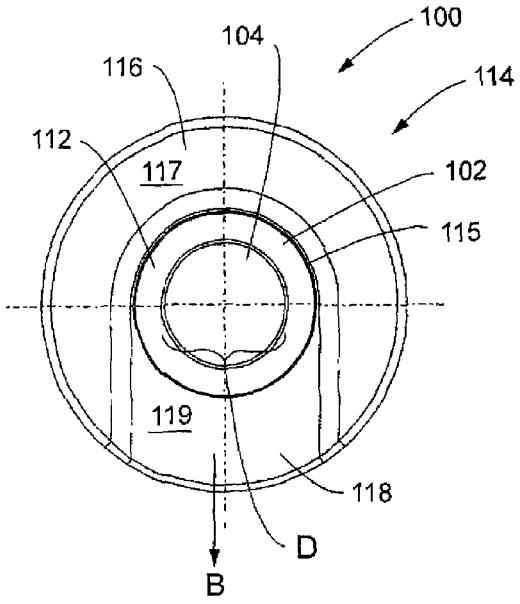
FIG. 1 is a plan view of a coin counter/distributor apparatus in accordance with the invention.

The principles of the invention are disclosed with respect to a coin counter/distributor apparatus 100 as illustrated in FIGS. 1-9 and described herein. For purposes of brevity, the coin counter/distributor apparatus 100 will be described herein as the "coin apparatus 100" or the "apparatus 100." The coin apparatus 100 is particularly advantageous in that it provides for a means for counting, storing and stacking coins of a particular denomination. The coins are stored and stacked in a manner so as to facilitate the filling of standard coin wrappers with the stacked coins. In accordance with one aspect of the invention, the coin apparatus 100 is sized and configured so that the vertically disposed coin apparatus 100 can be stacked with what would essentially be a "overflow" of coins of a particular denomination. By essentially "tipping" the vertically disposed coin apparatus 100, a predetermined number of the coins of the particular denomination can be maintained within the coin apparatus 100, while an excess of the coins (over and above the predetermined desired amount) will drop away from the coin apparatus 100.

In addition to the foregoing, a particularly advantageous concept of the invention relates to the capability of providing a means for readily distributing a predetermined number of the stored and stacked coins through manual action by a user. This predetermined number of the stored coins can essentially be in the form of a predetermined fraction of the total number of coins held by the coin apparatus 100. In accordance with another aspect of the invention, the coin apparatus 100 includes means not only for providing for the capability of distributing or allocating a predetermined number of a full set of stacked coins, but also providing the capability for selecting the predetermined number of coins to be distributed from a number of available selections. For example, and dependent upon the particular configuration of the coin apparatus 100 utilized in accordance with the invention, a user may be capable of allocating 20%, 40%, 60% or 80% of a full set of coinage. Again, such allocation or distribution is provided through manual manipulation and manual external forces exerted on certain components of the coin apparatus 100.

Turning to the drawings, and first to FIGS. 1-5, the particular embodiment of the coin apparatus 100 in accordance with the invention illustrated therein is in the form of a tubular intermediate section, upper frontal-type section and lower cylindrical base. More specifically, these components can be defined as including a central coin housing 102. The coin housing 102 has a substantially cylindrical or tubular configuration, is elongated and vertically disposed in its conventional position. The central coin housing 102 includes a coin holding interior 104. The holding interior 104 is essentially formed as a hollow interior and is of a tubular or cylindrical design. The coin holding interior 104 has a diameter (characterized as diameter D in FIG. 1) which is sized so as to provide for coins of a predetermined denomination to be "snuggly" received as a stack having the coins each with a horizontally disposed configuration. An illustration of coins is shown as coins 106 in FIG. 5.

Figure 2:
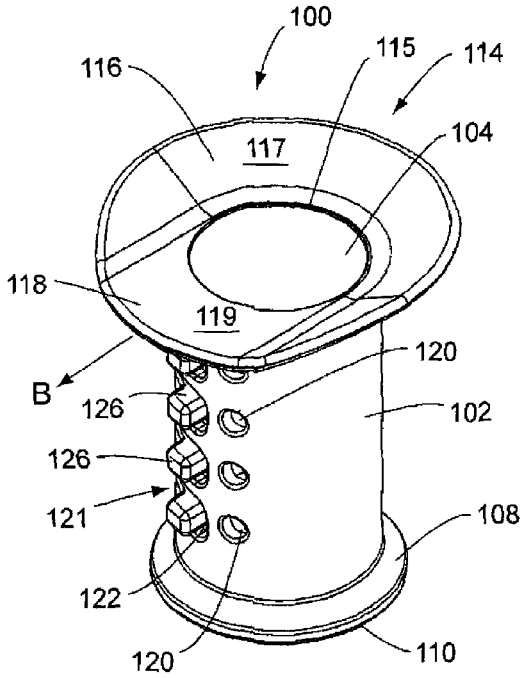
FIG. 2 is an upper, perspective view of the coin apparatus shown in FIG. 1.
Figure 3:
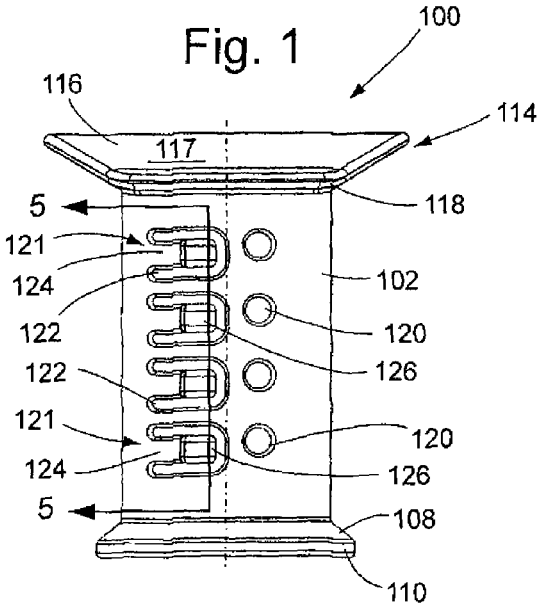
FIG. 3 is a front, elevation view of the coin apparatus shown in FIG. 1.
Figure 4:
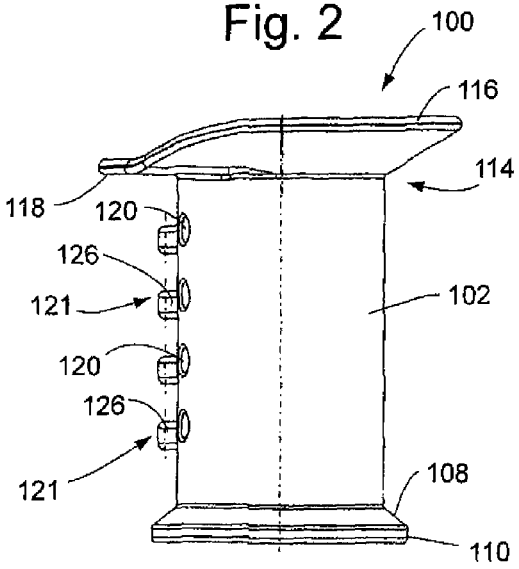
FIG. 4 is a right-side elevation view of the coin apparatus shown in FIG. 1.
Figure 5:
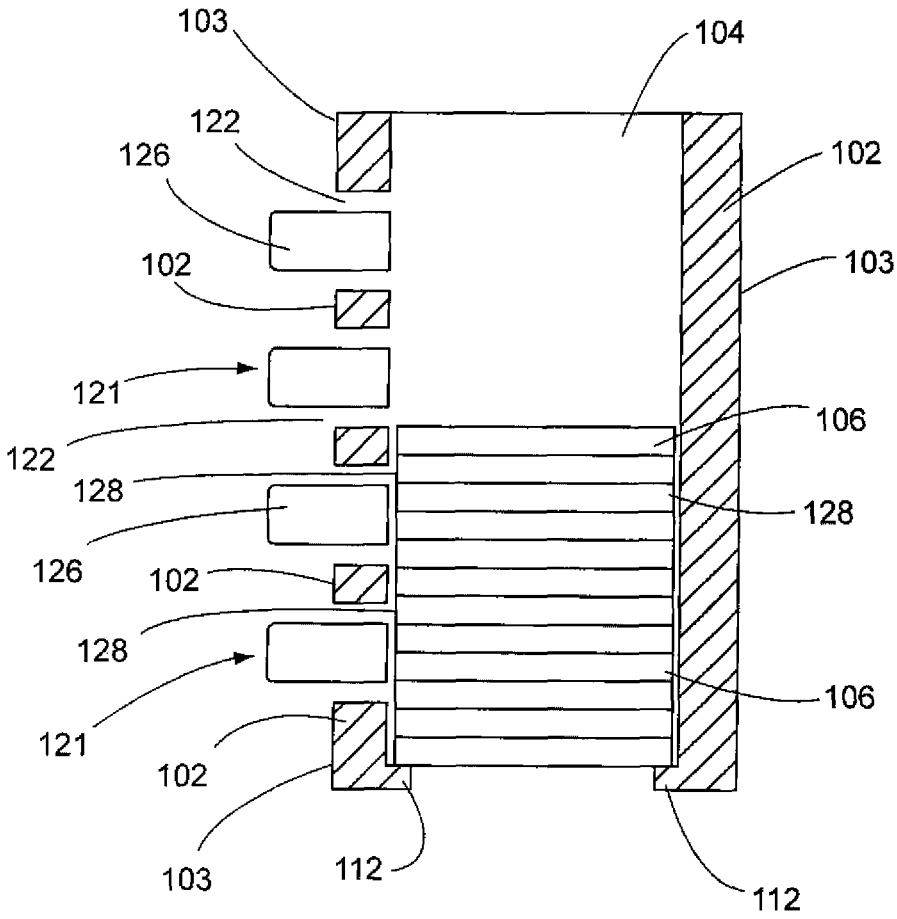
FIG. 5 is a side, sectional view of the coin apparatus shown in FIG. 1 and showing the coin apparatus partially filled with coins, and taken along section lines 5-5 of FIG. 3.
Figure 6:
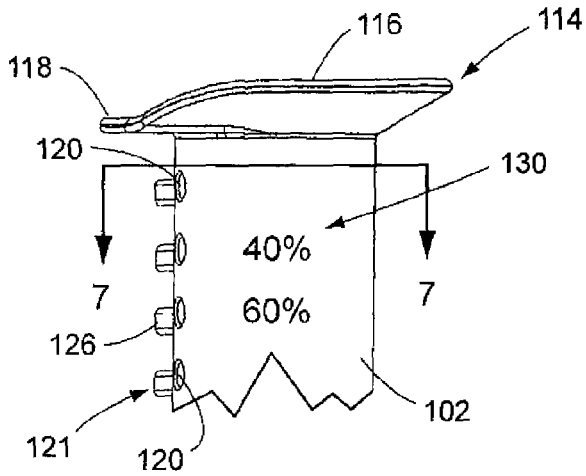
FIG. 6 is a right-side elevation view of an upper portion of the coin apparatus shown in FIG. 1.

The central coin housing 102 is positioned above a lower apparatus base 108, primarily shown in FIGS. 2, 3 and 4. The lower apparatus base 108 can be secured in any suitable manner to the central coin housing 102, or can be integral therewith. In the embodiment of the coin apparatus 100 shown in the drawings, the lower apparatus base 108 has essentially a frustum shaped configuration, with a lower pedestal 110. As shown in FIG. 1, the coin holding interior 104 is essentially hollow and extends through the bottom of the coin apparatus 100. However, for purposes of providing a support for coins 106 at the bottom of the coin apparatus 100, the central housing 102 extends inwardly so as to essentially form an annulus 112 which extends inwardly from the sides of the central housing 102 (see FIGS. 1 and 5). As particularly shown in FIG. 5, the annulus 112 can be integral with the sides of the central housing 102.

In addition to the central coin housing 102 and the lower apparatus base 108, the coin apparatus 100 also includes an upper funnel/distributor section 114. The funnel/distribution section 114 is shown primarily in FIGS. 1-4, 6 and 8. The funnel/distribution section 114 provides for a relatively "wide" area for a user to insert coins 106 into the coin holding interior 104. The funnel/distributor section 114 includes an opening in the center thereof which corresponds substantially in diameter to the diameter D of the coin holding interior 104. The upper funnel/distributor section 114 includes a funnel section 116 which essentially is in the form of a part of an inverse frustrum-shaped conical figure. With this formation, the funnel section 116 includes an upper surface 117 (FIGS. 1 and 2) which is inclined or slanted downwardly and inwardly toward the upper portion of the coin holding interior. The open central portion of the funnel/distributor section 114 which is of substantially the same diameter as diameter D of the coin holding interior 104 can be characterized as a funnel/distributor aperture 115, as shown in FIGS. 1 and 2. As a user drops or otherwise positions coins 106 on the upper surface 117 of the funnel section 116, the coins 106 will essentially "slide" into the coin holding interior 104 in a vertically disposed configuration.

In addition to the funnel section 116, the upper funnel/distributor section 114 also includes a trough 118. The trough 118 is primarily shown in FIGS. 1-4, 6 and 8. The trough 118 is preferably integral with the funnel section 116 and includes an upper surface 119 (FIGS. 1 and 2) which comprises a relatively horizontally disposed surface. The primary purpose of the trough 118 is to provide a means for the user to readily remove any excess coinage which has been placed within the funnel section 116. That is, it can be assumed that the height of the central coin housing 102 is configured so that when the coin holding interior 104 holds the appropriate number of coins 106 for storage within a tile wrapper or the like, the upper one of the coins 106 will be substantially flush with the open central portion funnel/distributor section 114, corresponding to the uppermost portion of the coin holding interior 104. Any excess coinage will extend above the funnel/distributor section 114. If a user slightly tips the coin apparatus 100 in the direction shown by arrow B in FIGS. 1 and 2, the excess coinage should essentially "slide" out of the funnel/distributor section 114 on the upper surface 119 of the trough 118. In this manner, the configuration of the upper funnel/distributor section 114 facilitates the obtaining of appropriate numbers of coins 106 within the coin holding interior 104, and also facilitates removal of excess coinage.

Preferably, the coin apparatus 100 can also include a series of indicator apertures 120 which extend through the central coin housing 102. These indicator apertures 120 are shown in FIGS. 2, 3, 4, 6 and 8. In the particular embodiment described herein, the drawings illustrate four indicator apertures 120, with the indicator apertures 120 having a vertically disposed configuration on the housing 102. The primary purpose for the indicator apertures 120 is to provide a visual means for a user to determine the number of coins 106 when the coin holding interior 104 is only partially full. That is, the positioning of the indicator apertures 120 can essentially be "calibrated" so that when an upper surface of the uppermost coin 106 stored within the coin holding interior 104 is visible within a particular indicator aperture 120, the user can determine (preferably by visible indicia on the surface of the central coin housing 102) the total number of coins 106, or the value of the total number of coins 106 which are then currently within the coin holding interior 104. In this regard, the indicator apertures 120 need to be calibrated with respect both to vertical position on the central coin housing 102, as well as sized in a manner so that the diameter of each aperture 120 exceeds the thickness of a coin 106. Otherwise, it may be possible to show an upper surface of a coin 106 within a particularly aperture 120 not only for a specific number of coins, but also for the specific number of coins "+1." It is apparent that the actual number of indicator apertures 120 and their relative positioning can be determined at the time of assembly of the coin apparatus 100, and can be variable. It is also apparent that with respect to the number of indicator apertures 120, the greater the number of apertures 120, the more specific are the visual indications of the user as to the number of coins 106 (or the value of the coins 106) then stacked within the coin holding interior 104.

In accordance with a primary aspect of the coin apparatus 100 in accordance with the invention, the apparatus further includes a series of what can be called coinage selectors 121 which are primarily shown in full in FIG. 3, and partially in FIGS. 2 and 4-9. The coinage selectors 121 provide means for a user to manually select a predetermined number of coins 106 (and therefore a predetermined monetary amount of coinage) to be distributed through the use of the coin apparatus 100. Turning to the drawings, FIG. 3 illustrates four of the coinage selectors 121. Although this particular embodiment of the coin apparatus 100 in accordance with the invention shows four coinage selectors 121, any number of coinage selectors 121 can be incorporated within a coin apparatus in accordance with the invention. In this particular instance, FIG. 3 illustrates the coinage selectors 121 as being in a vertically disposed configuration, one on top of the other within the central coin housing 102. This particular configuration is not necessary, and the coinage selectors 121 can be "staggered" around the central coin housing 102.

Figure 7:
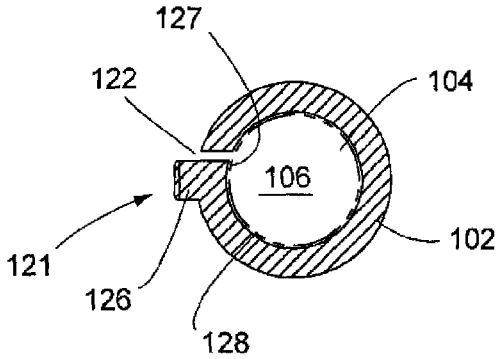
FIG. 7 is a top, sectional view of the coin apparatus shown in FIG. 1, taken along section lines 7-7 of FIG. 6.
Figure 8:
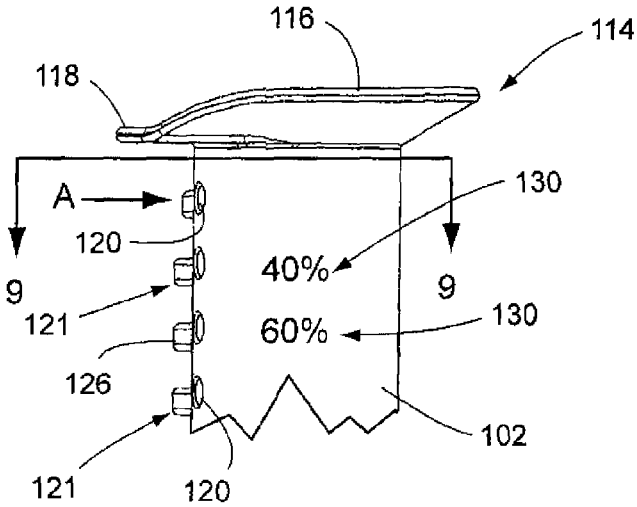
FIG. 8 is a right-side sectional view of an upper portion of the coin apparatus shown in FIG. 1.
Figure 9:
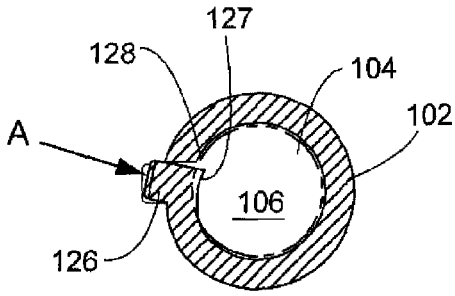
FIG. 9 is a top, sectional view of the coin apparatus shown in FIG. 8, taken along section lines 9-9 of FIG. 8, and showing the relative positioning of a button in a depressed state so as to appropriately allocate and distribute a predetermined number of coins.

Each of the coinage selectors 121 includes an allocation slot 122 extending through the central coin housing 102 and having the configuration primarily illustrated in FIG. 3. Extending inwardly toward the center of each allocation slot 122 from the central coin housing 102 is a resilient arm 124. The arm 124 is preferably integral with the central coin housing 102 and requires only a relatively slight amount of resiliency for purposes of appropriate functional operation. Position at the end of each resilient arm 124 which extends into a corresponding one of the allocation slots 122 is what can be characterized as a button 126. The button 126 is primarily shown in FIGS. 2-9. Preferably, the button 126 is integral with the resilient arm 124, for purposes of facilitating manufacture. As shown in FIGS. 7 and 9, each of the buttons 126 includes an inner edge 127. The resiliency of each arm 124 and corresponding button 126 is sufficient so that if the user exerts manually directed forces against one of the buttons 126 in the direction shown as direction A in FIGS. 8 and 9, the button 126 will sufficiently flex so that the inner edge 127 will securely abut one or more edges 128 (see FIG. 5) of coins 126 which are within the coin holding interior 104 and which are at essentially the same vertical height as the corresponding button 126.

In view of all of the forgoing, the positioning of the allocation slots 122, resilient arms 124 and buttons 126 can essentially be "calibrated" with respect to their vertical positioning along the central coin housing 102. That is, for example, it can be assumed that the coin apparatus 100 includes a "full" set of coins 106, corresponding to a known number of coins and a known monetary amount. If it is desired to facilitate distribution or allocation of 50% or ½ of the total number of coins 106, one of the allocation slots 122 can be vertically positioned along the central coin housing 102 at a particular predetermined vertical height. Reference will now be made in particular to FIGS. 8 and 9. The vertical height of the particular allocation slot 122 will be one which would insure that when a user inserts forces in the direction A on a corresponding button 126 (as expressly shown in FIG. 9), the inner edge 127 of the button 126 would securely abut edges 128 of one or more of the coins 126. The calibration of the vertical positioning of the allocation slot 122 would be such that the abutment of the button 126 with the particular one or more coins 106 would be such that if all of the coins above the uppermost coin abutted by the inner edge 127 were to be removed from the coin holding interior 104, the total amount of coinage removed would correspond to 50% of the full set of the coins 106.

Preferably, visual indicia (such as visual indicia 130 illustrated in FIGS. 7 and 8) would be incorporated within the outer surface of the central coin housing 102 which would indicate to a user that if that particular resilient arm 144 and button 126 associated with that particular allocation slot 122 was to be "depressed" so as to cause the inner edge 127 of the button 126 to abut one or more of the coins 106, 40% of the coinage would be above the uppermost coin 106 which is abutted by the inner edge 127. Accordingly, if the user wished to distribute 40% of the coinage corresponding to a full set of the coins 106, the user could depress the corresponding button 126 and invert the entirety of the coin apparatus 100. In this manner, 40% of the total amount of a full set of the coins 106 would, through gravity, fall through the funnel/distributor aperture 115 and outwardly from the coin apparatus 100.

With the foregoing description, it is apparent that the various allocation slots 122 can be vertically positioned along the central coin housing 102 in a manner as desired so as to facilitate distribution of various percentages (or monetary amounts) of the full set of coins 106 which are held by the central coin housing 102. Also, it is apparent from the foregoing description that the total number of allocation slots 122 can be varied, depending upon the number of optional percentages of distribution desired by the manufacture and user. The coin apparatus 100 and other coin apparatus in accordance with the invention are particularly advantageous with respect to their relative structure, in that all or a substantial number of the components of the coin apparatus 100 can be made integral with each other during the manufacturing process. The coin apparatus 100 is particularly useful in design if the apparatus is molded. Also, the pressure desired by the manufacturer which would be required to be exerted against the buttons 126 so as to cause the buttons 126 to securely abut the coinage can be chosen as a matter of design.

It will be apparent to those skilled in the pertinent arts that other embodiments of coin apparatus in accordance with the invention can be designed. That is, the principles of coin apparatus in accordance with the invention are not limited to the specific embodiment described herein. Accordingly, it will be apparent to those skilled in the art that modifications and other variations of the above-described illustrative embodiment of the invention may be effected without departing from the spirit and scope of the novel concepts of the invention.

What is claimed is:

1. A coin apparatus for counting, storing and distributing coins, said apparatus comprising:

a central housing having a vertically disposed configuration when in a standard configuration;

a hollow coin holding interior formed within said central housing;

said central housing having a housing exterior; and distributing means for distributing a predetermined number of said plurality of coins stored within said central housing, in response to manually exerted forces applied toward said housing exterior of said central housing, said distributing means comprises a plurality of coin selectors for providing means for said user to manually select a predetermined number of coins to be distributed through use of said coin apparatus; each of said coin selectors comprises:

an allocation slot extending through said housing exterior;

a resilient arm;

said resilient arm at least partially following the circumference of the coin;

a button integral with said resilient arm, and positioned at an end of said resilient arm and having an inner edge; and in response to manual forces exerted against said button in a direction towards said housing exterior, said resilient arm will deflect into said interior and securely abut an edge of at least one coin so as to prohibit movement of said at least one coin.

2. A coin apparatus in accordance with claim 1, characterized in that said apparatus further comprises means for indicating to said user the portion of the total number of said coins being held by said coin apparatus, which is represented by said predetermined number of said coins.

3. A coin apparatus in accordance with claim 2, characterized in that said portion of said stored coins is indicated to said user as a fraction of said total number of said coins held by said coin apparatus.

4. A coin apparatus in accordance with claim 1, characterized in that said means for providing for said user to select said predetermined number of said coins held by said coin apparatus comprise means for providing for said user to select said predetermined number of said stored coins from a plurality of available portions selectable by said user, by said user applying forces toward said housing exterior at different locations on said exterior.

5. A coin apparatus in accordance with claim 1, characterized in that said apparatus comprises a series of indicator apertures extending through said housing exterior and having a vertically disposed configuration on said housing exterior, for providing a visual means for a user to determine a number of stored ones of said coins when said coin holding interior is only partially full.

6. A coin apparatus in accordance with claim 5, characterized in that a diameter of each one of said apertures exceeds the thickness of any one of said stored coins.

7. A coin apparatus in accordance with claim 1, characterized in that said coin selectors are positioned in a configuration where one coin selector is above or below other ones of said coin selectors.

8. A coin apparatus in accordance with claim 1, characterized in that said position of said coin selectors on said housing exterior is staggered around said housing exterior.

* * * * *